US005918418A

United States Patent [19]

Richmond et al.

[11] Patent Number: 5,918,418

[45] Date of Patent: Jul. 6, 1999

[54] OVERHEAD DOOR OPERATOR

[75] Inventors: Moscow K. Richmond, Inglewood; Thomas R. Richmond, Santa Ana; Patrick S. Kochie, Simi Valley, all of Calif.

[73] Assignee: Doorking, Inc., Inglewood, Calif.

[21] Appl. No.: 08/850,620

[22] Filed: May 2, 1997

[51] Int. Cl.[6] ..... E05F 15/00

[52] U.S. Cl. ..... 49/139; 49/199

[58] Field of Search ..... 49/139, 140, 197, 49/199

[56] References Cited

U.S. PATENT DOCUMENTS 2,589,480 3/1952 Curtis ..... 49/139 X 3,630,094 12/1971 Carli ..... 49/139 X

*Primary Examiner*—Jerry Redman

*Attorney, Agent, or Firm*—Robert J. Schaap

[57] ABSTRACT

An operator for an overhead door, such as a garage door, to raise and lower the door. The operator comprises a chain drive which is rotated about upper and lower pulleys and powered by a drive motor. Preferably, a pair of spaced apart drive chains are employed. A carriage is secured to the one or a pair of drive chains and is releasably connected to the drive chains by connecting blocks extending outwardly from the carriage. The garage door is thereupon secured to the carriage for raising and lowering movement thereof. Each drive chain includes one double-pitch link for connecting the ends of the chain to form a continuous loop. Each connecting block is provided with a releasable pin which extends into the double-pitch link for releasably securing the carriage to the drive chains. Removal of the pin for each drive chain will allow manual movement of the carriage and hence, the door. This construction precludes the connecting blocks or carriage from being driven to the sprocket where they would attempt to drive around the sprocket in the event that limit switches are not properly set. This construction also allows one to manually disengage the drive chain from the carriage in order to move the carriage and door in the event of a power failure.

24 Claims, 3 Drawing Sheets

OVERHEAD DOOR OPERATOR

BACKGROUND OF THE INVENTION

1. Field of the Invention

This invention relates in general to certain new and useful improvements in overhead door operators, and more particularly, to an overhead door operator, which precludes damage to the operator in the event of improperly set limit switches.

2. Brief Description of the Prior Art

Overhead doors, such as garage doors, are widely employed in industrial, commercial and residential applications. Very frequently, the garage door is a segmented door, which is raised to an overhead position and lowered to the closed position by means of a door operator.

The overhead door is typically constructed of a plurality of vertically arranged segments and each of the segments are pivotally connected to one another so as to be capable of turning about an arcuate bend at or adjacent to the upper portion of a track supporting the door. Moreover, rollers are secured to the individual segments and moved in a trackway at each of the opposite ends of the door. In this way, a controlled opening and closing movement is achieved.

There are a large number of different ways to couple the openable and closable door to a powered unit, such as an electric motor. One of the common ways is to cause rotation of a pinion gear which is disposed in meshing engagement with a rack and which is, in turn, driven by the drive unit. Another means for driving the garage door is to use a chain located in a guides at each of the opposite sides of the garage door. Generally, where drive chains are employed, the ends of the chains are connected either to the carriage or the connecting block mounted on that carriage rather than being connected to each other in a continuous loop. As a result, a problem can arise, as hereinafter described, in the event that limits of movement of the carriage are not properly set.

Most garage door openers necessarily employ some means to release the door from the operator in order to enable manual opening in the event of a power failure. However, in all garage door openers, it is necessary to install limit switches or like limit controlling members to control the limit of movement of the door between the open and the closed positions. In the event that is the limits are not properly set, or otherwise, if the installer is not particularly careful during installation, the carriage, which connects the garage door to the drive chains, would be driven to the upper drive sprocket. The power drive unit, such as the electric motor, would attempt to force the carriage around the drive sprocket thereby damaging the sprocket or the carriage, or both.

It can be appreciated that any inadvertent driving of the carriage to the limit of the sprockets and any attempt to drive the carriage around the sprockets would result in costly damage potentially necessitating a change of the sprockets and perhaps even the installation of a new carriage. Not only is this costly, but it is also involves time consuming repair.

There has been a need for an overhead door operator in which any inadvertent driving of a carriage to, or attempting to power the carriage around, a drive sprocket is eliminated.

OBJECTS OF THE INVENTION

It is, therefore, one of the primary objects of the present invention to provide an overhead door operator which positively drives a carriage and an attached door and which will preclude any powering movement of the carriage to or around an upper drive sprockets and which thereby eliminates potential damage to the carriage and/or the sprockets.

It is another object of the invention to provide an overhead door operator of the type stated which will provide a positive drive action and which permits easy and convenient releasable coupling of the drive carriage to drive chains forming part of the door operator.

It is a further object of the present invention to provide an overhead door operator of the type stated which can be it used in a variety of overhead door installations, including industrial installations, commercial installations and residential installations.

It is an additional object of the present invention to provide an overhead door operator of the type stated which can be constructed at a relatively low cost and which is highly efficient in operation.

It is another salient object of the present invention to provide an overhead door operator of the type stated which utilizes a double-pitch link for releasably coupling a carriage for the door to drive chains forming part of the door operator.

With the above and other objects in view, our invention resides in the novel features of form, construction, arrangement and combination of parts and components presently described and pointed out in the claims.

BRIEF SUMMARY OF THE INVENTION

An overhead door operator capable of moving a door between an opened position and a closed position. Generally, the door is an overhead segmented door, such as a garage door and usually travels in a movement path which has a partially vertical component and a component which is angularly displaced from the vertical path, such as a horizontal component.

The door operator generally comprises a power drive means, such as, for example, an electric motor drive means. This electric motor drive means usually comprises an electric motor having a drive shaft which rotates one or more rotatable elements, such as sprockets.

The door operator also comprises guide means for controlling the path of movement of the door during movement between the opened position and the closed position. A chain is typically trained about the rotatable elements, such as sprockets, and the chain is comprised of a plurality of links. The chain is powered for movement by the drive means and with respect to the guide means. Typically, the chain is movable within the guide means or trackway. Inasmuch as the chain is trained about one or more driven sprockets, the chain is also powered for movement in the guideway.

The rotatable elements, such as the sprockets, enables the door to translate from the vertical movement path to an angularly located movement path, such as a horizontally disposed movement path. However, the exact movement path is not critical with respect to the operator of the present invention.

As indicated previously, in connection with some of the overhead door operators in the prior art, if a powered drive member such as an electric motor caused movement of a mounting block on a chain or a carriage secured to that mounting block to a point where the mounting block or the carriage would attempt to be trained around a sprocket in an angularly displaced direction, damage could result to the entire drive mechanism. This was typically the case where the ends of the chain were connected to the carriage or the mounting block on that carriage. If a mounting block with a heavy carriage secured thereto were pulled over a sprocket from a vertical direction to a horizontal direction, it would damage the mounting block and very likely damage the carriage as well as possibly damaging the sprockets and causing an induced strain on the drive motor. Although limit switches are typically employed to prevent this type of damage, if the limit switches are not properly in adjustment, damage of this type can readily result.

The present invention relates to a mechanism which also uses an electric drive motor and drive chains located in trackways in the opposite vertical sides of the overhead door guide path. These drive chains are trained around sprockets at the upper end lower ends of the path of movement and thereby cause a raising and lowering movement of the overhead door from a closed position to an open position and back to a closed position. Limit switches are also provided and are electrically connected to the drive motor through a control mechanism to cause a cessation of driving movement when the mounting block reaches the upper limit of travel or the lower limit of travel. However, if the limit switches are not properly set, the present invention provides an overhead operator mechanism which will nevertheless preclude driving movement over the sprockets.

In accordance with the present invention, this invention can be described in broad terms as a power drive means such as the electric motor, guide means such as trackways for controlling a path of movement of the door during movement between the open and closed positions, and a chain comprised of a plurality of links which is powered for movement by the drive means with respect to the guide means. A rotatable element such as a sprocket is located with respect to the guide means allowing the chain to be trained about and rotated about the rotatable element during a portion of the movement with respect to the guide path. A carriage is movable by the chain with respect to the guide means and is capable of moving a door therewith during movement between the opened and closed positions.

In accordance with the present invention, the ends of the drive chain are not connected directly to the carriage or the mounting block on the carriage. Rather, the ends of the drive chain are connected together by an enlarged link, frequently referred to herein as a "double pitch" link. The carriage which also carries the door is secured to this drive chain by means of a pin at the double pitch link.

The operator also employs a microprocessor which effectively controls the movement of the gate. The microprocessor will effectively enable measurement of the distance of movement of the door on the first occasion in which the door is moved from the opened position to the closed position and will also make a similar measurement when the door is moved from the closed position to the opened position. This distance measurements are stored, by way of counts, in the microprocessor and these counts are used to control the movement of the door or gate on subsequent occasions.

The present invention, in addition to the use of limit switches, also employs physical stops. Thus, when the carriage should reach an uppermost or lowermost position of travel in the vertical travel path, it will automatically engage these stops and stop movement of the carriage and hence, the door or gate itself. Thus, the stops effectively preclude the carriage from attempting to travel around the sprockets at the upper or lower ends of the drive paths. In this way, if the carriage should be shifted to a position adjacent the upper or lower sprocket, the drive chain will not tend to pull the carriage over the sprocket. Rather, the motor may momentarily stall, but would nevertheless preclude rotation of the carriage about the sprockets and avoid any potential damage resulting therefrom.

The use of a pin, as hereinafter described, in an enlarged link also constitutes a release means for disengaging the carriage from the chain. Thus, in the event of a power failure or other reason to manually cause movement of the gate or door, the pin can be pulled from the chain to thereby permit a freely rotatable movement of the chain with respect to the door and hence also permit the door to move independently of the chain.

This release means further comprises a block secured to the carriage and has the releasable pin extended to and engageable with an enlarged link in the chain in such manner that the pin can be pulled from the chain and the carriage will become disconnected from the chain and thereby stop movement of the carriage. This pin is normally spring biased into engagement with the chain. Thus, when the pin is moved from its engaged position in a double pitch link, and if the motor is operated, the chain will continuously move around the drive path. However, since the carriage is not connected thereto, there will be no further movement of the carriage.

Each of the links in the chain has an opening. However, the enlarged link has an enlarged opening, as for example, a size much greater than each of the other links and is typically referred to as a "double pitch" link. In this case, the pin can be pulled out of the double pitch link. The use of the double pitch link has two distinct advantages in accordance with the present invention. In the first case, it will permit manual disengagement of the drive chain from the carriage thereby allowing one to manually move the door and the carriage, as for example, in the event of a power failure.

The advantage of the double pitch link to receive the pin also preclude damage to the operating mechanism, as aforesaid. In this case, and although the drive chain may still be connected to the carriage during movement, if the limits switches are not properly set, the drive carriage will hit the upper stop and the microprocessor which controls the operation of the controller will thereby cause de-energization of the drive motor. In this way, damage to the drive mechanism is precluded.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention, but it is to be understood that the following detailed description and these accompanying drawings are not to be taken in a limiting sense.

BRIEF DESCRIPTION OF THE DRAWINGS

Figure 1:
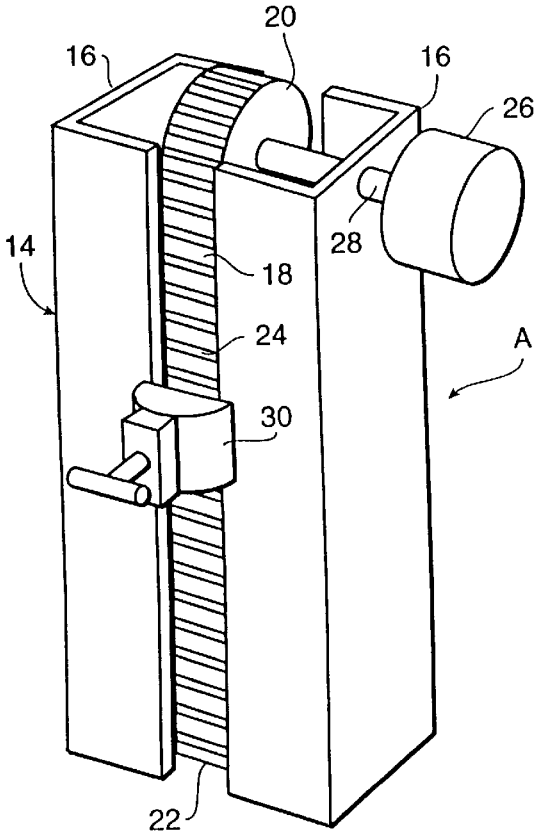
Figure 2:
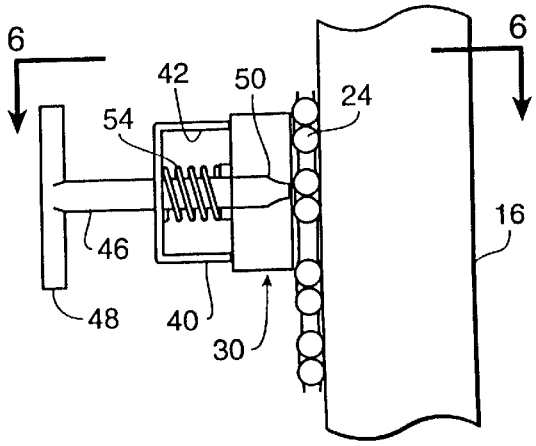
Figure 3:
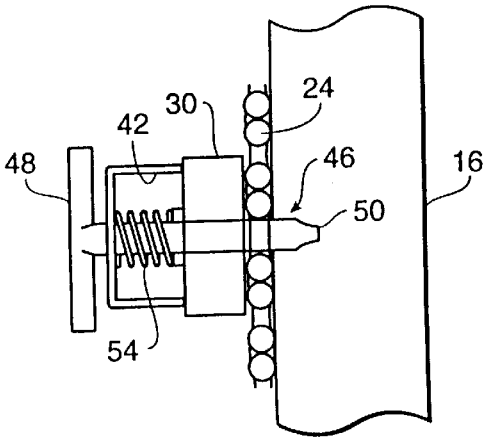
Figure 4:
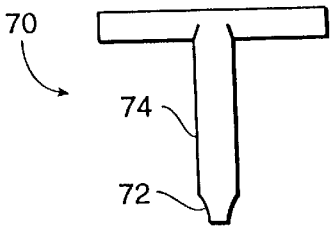
Figure 5:
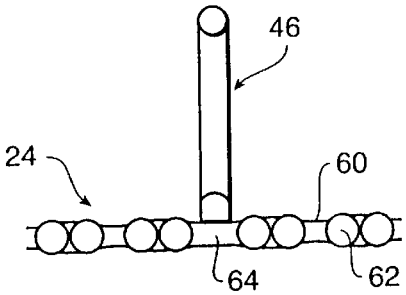
Figure 6:
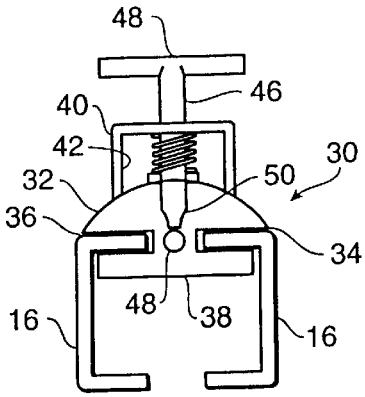
Figure 7:
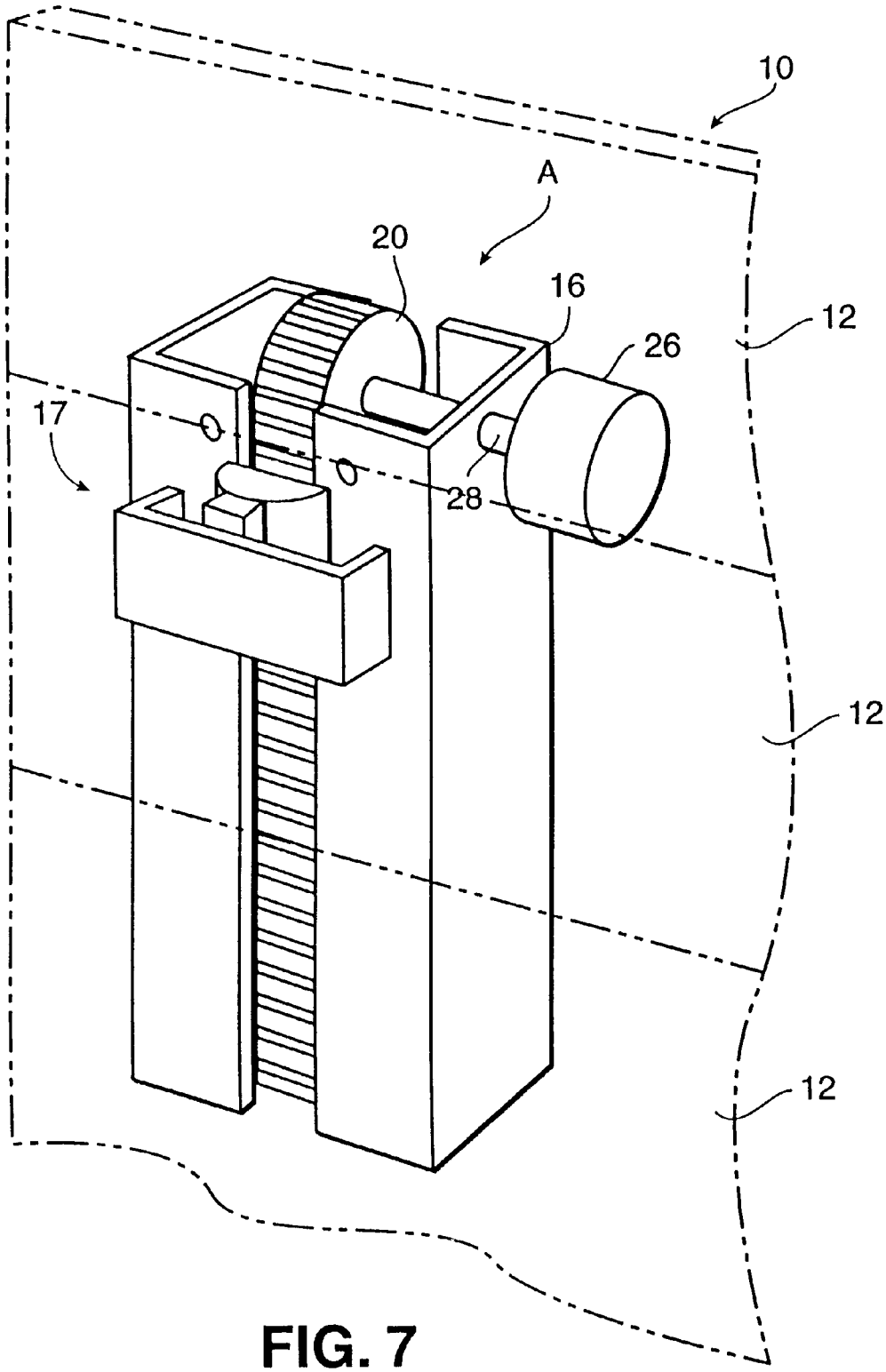
Figure 8:
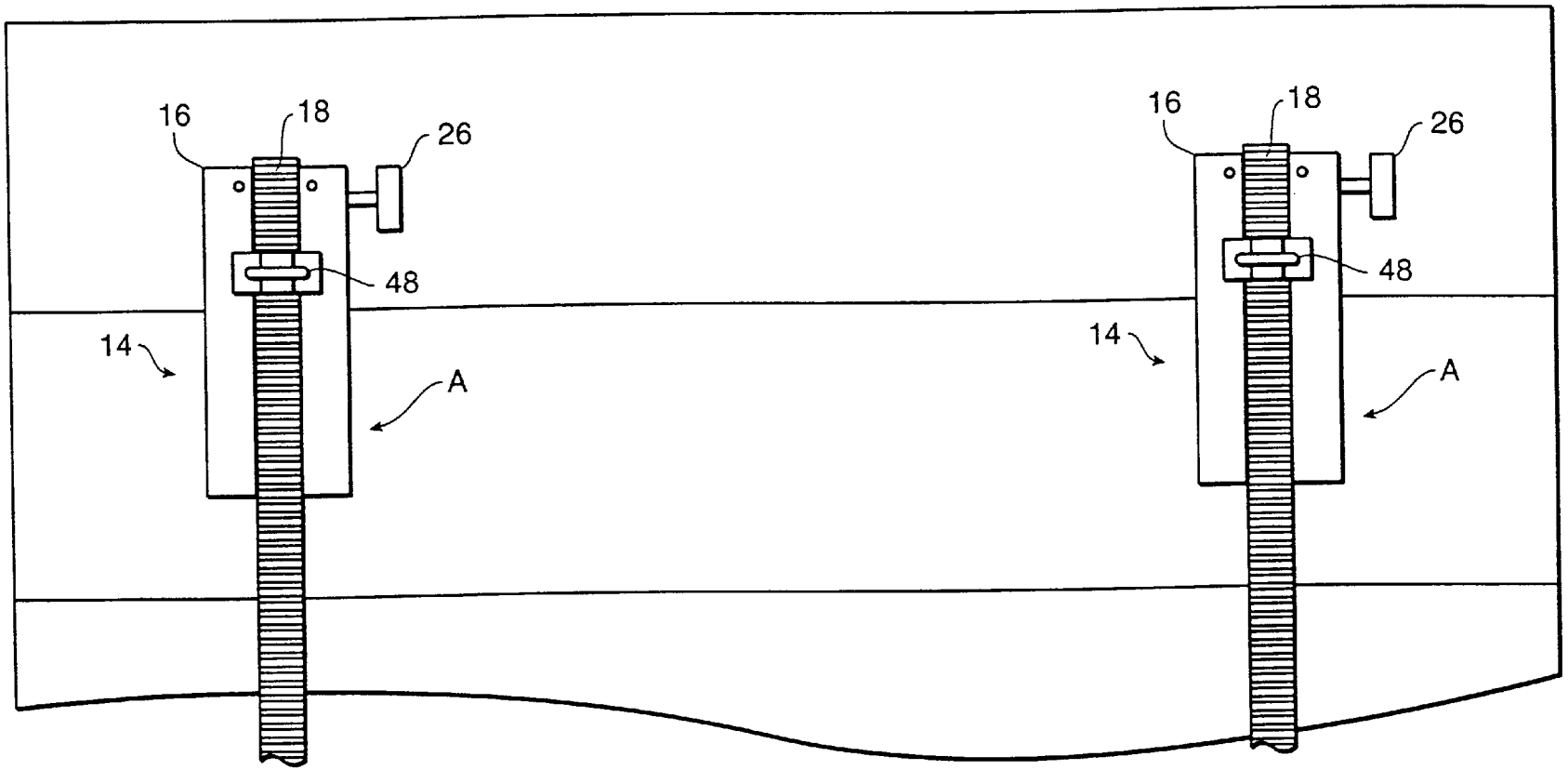

Having thus described the invention in general terms, reference will now be made to the accompanying drawings (two sheets) in which:

FIG. 1 is a perspective view of a portion of a drive mechanism forming part of an overhead door operator in accordance with the present invention;

FIG. 2 is a vertical sectional view of a portion of the drive mechanism of FIG. 1;

FIG. 3 is a fragmentary vertical sectional view of a portion of the drive mechanism, and similar to FIG. 2, and showing a locking pin in engagement with a drive chain forming a part of the drive mechanism;

FIG. 4 is a front elevational view of a pin forming part of the drive mechanism of the present invention;

FIG. 5 is a fragmentary enlarged front elevational view showing a portion of the pin with respect to a double pitched link in a drive chain forming part of the drive mechanism of the present invention;

FIG. 6 is a vertical sectional view taken along the plane of line 6—6 of FIG. 2 and showing a pin with respect to mounting block forming part of the invention; and FIG. 7 is a fragmentary perspective view showing an upper portion of the drive mechanism of the present invention including a drive motor and drive sprocket with a chained train thereabout and forming part of the drive mechanism; and FIG. 8 illustrates an embodiment of the invention in which a pair of drive chains are employed on opposite sides of the overhead door operator mechanism.

DETAILED DESCRIPTION OF A PREFERRED EMBODIMENT

Referring now in more detail and by reference characters to the drawings which illustrate a preferred embodiment of the present invention, "A" designates an overhead door operator for moving a door 10 of the type schematically illustrated by the dotted lines of FIG. 7.

The door 10, as shown on FIG. 7, does not form part of the invention and is a door which merely blocks access to or permits access through an access opening, such as into a garage or the like. The door 10 is typically, although not necessarily, formed of a plurality of vertically arranged panels 12 which are vertically aligned with one another when in the closed position. These panels, however, permit the folding of portions of the panels with respect to the remainder to allow the door to be trained over roller mechanisms and the like.

In accordance with the present invention, the gate operator "A" comprises a pair of door guide and drive sections of 14, one of which is more fully illustrated in FIGS. 1 and 7 of the drawings. Although only one guide and drive section 14 has been shown adjacent the left side of door 10, it should be understood that a pair of these guide and drive sections will be provided, e.g., with an opposite section on the right-hand side of the door 10.

Each guide and drive section 14 generally comprises a post in the form of opposed U-shaped channels 16 which together form a trackway 18. A sprocket 20 is located adjacent the upper ends and extends between each of these channels in a manner as best shown in FIGS. 1 and 7. In like manner, a like sprocket 22 is located adjacent the lower end and extends between each of the two channel 16, as best shown in FIG. 1. A drive chain or similar type of drive member, such as a drive belt 24, is trained about and forms a continuous loop between the upper sprocket 20 and the lower sprocket 22.

In the embodiment of the invention, as shown, an electric motor drive 26 is provided for driving the upper sprocket 20 through a drive shift 28. This drive motor 26 would be mounted in any suitable fashion on one of the channels 16. Moreover, the drive motor 26 is preferably a synchronized drive motor and connected to a control system for controlling the operation the door operator.

Although one such guide and drive section 14 has been shown in FIG. 1, as indicated previously, a similar guide and drive section would be located at the opposite side of the door 10. FIG. 8 illustrates an embodiment of the invention in which a pair of drive chains are employed on opposite sides of the overhead door operator mechanism. In this respect, like reference numerals which have been used in connection with FIGS. 1–7 are also used in connection with the embodiment of FIG. 8. However, it should be recognized that the other guide and drive system may actually not function with a drive system per se. In that case, only the channels forming the trackway would be provided with the sprockets, as shown, but without the electric motor drive 26. However, if desired, a pair of synchronized drive motors may be provided.

A carriage 30 is mounted on and movable with the drive chains 20 and 24 as the latter is rotated about the sprockets 20 and 22. The carriage 30 comprises a somewhat elongate block 32 with a pair of slots 34 to receive edges of the opposed channel members 16, in the manner as best illustrated in FIG. 6 of the drawings. Thus, the block 32 has a front section 36 which rides against the exterior face of the opposed channels 16 and a rear section 38 which rides against the interior surface of each of those same channels 16, all as best illustrated in FIG. 6 of the drawing. Mounted on and extending forwardly of the block 32 is a chain receiving member 42 which is also formed of a U-shaped channel piece. This channel piece provides a vertically extending opening to receive the drive chain 24, all in the matter as best illustrated in FIG. 6 of the drawings.

The carriage 30 is locked to the drive chain 24 and movable therewith through a connecting pin of 46 which sits within a hole 48 in the block 32 and also through one of the rungs of the chain. In this way, the carriage becomes; locked to the chain 24 and is movable therewith. It can also be seen that when the pin 46 is pulled from the hole 48, the carriage will be freely shiftable with respect to the drive chain 24 and will not move with the drive chain 24. For this purpose, the pin 46 is provided with a handle 48. Moreover, the pin 46 also has a tapered lower end 50, all as best shown in FIGS. 2, 3 and 6 of the drawings.

By reference to FIG. 2 of the drawings, it can be seen that the pin 46 is normally biased to a position where the pin will be in engagement with one of the rungs in the drive chain 24 by means of a compression spring 54 which extends about the shank of the pin. In this way, even if the drive pin should be inadvertently removed from engagement with the drive chain, it would automatically be biased back into engagement therewith.

FIG. 2 actually shows the pin 46 pulled to the position where it is just beyond the drive chain 24 and not in engagement therewith. FIG. 3, on the other hand, shows the positioning of the pin through one of the rungs of the drive chain 24 so that the carriage is actually locked into a movable position with the drive chain 24.

FIG. 5 illustrates a drive chain which is used in accordance with the present invention. In this case, the drive chain 24 comprises a plurality of links 58 and each of which have a link opening 60. However, by reference to FIG. 5, it can be seen that the pin 46 has a shank diameter which is greater than the opening 60 in the link. Moreover, the diameter of the pin 46 is also greater than any spacing between each of the links.

The pin 46 is sized, however, to fit within a so-called double pitched link 62. The double pitched link 62 has an opening 64 which is twice the size of the openings 60 in the normal links 58. In this case, the diameter of the pin 46 is such that it will fit within the double pitched link but not in the other links.

FIG. 4 illustrates a slightly modified embodiment of the invention which includes a tapered pin 70 with pointed end 72 on its shank 74. Nevertheless, the relationship of the pin 70 is still the same with respect to the drive chain 24.

In accordance with the present invention, it can be seen that as a drive chain moves in a normal generally vertical path between the two sprockets 20 and 22, the pin 46 or for the matter the pin 70, will remain locked in the drive chain 24. As this occurs, the carriage 30 and the door mounted on the carriage 30 will be moved therewith unless the pin 46 is manually pulled from the engagement with the chain 24. As indicated previously, limit switches which are not shown, will be positioned with respect to the channels 16 so as to automatically de-energize the drive motor 26 when the carriage reaches a position in proximity to the upper sprocket 20 or the lower sprocket 22. However, if the limit switches are not properly set, or otherwise, are not opening, the drive chain 24 will continue to move about the sprocket in the direction of movement. The carriage will thereupon contact and be engaged against an upper stop 80.

The operator of the present invention also comprises a microprocessor (not shown) but which controls movement of the motor means or electric drive motor. One suitable highly effective type of control means is shown in U.S. Pat. No. 5,136,809, dated Aug. 11, 1992 and which is effective for measuring the amount of movement of the carriage and hinged gate or door on a first movement from a closed position to an opened position and back from the opened position to the closed position. This measure of movement in terms of counts is then stored and used to drive the gate or door on subsequent occasions between the limit of travel.

If the limit switches are not properly set, and the motor is energized, the carriage will move to an uppermost position of travel and engage a fixed stop. At this point in time, the motor will temporarily stall and the microprocessor will cause the motor to become de-energized. Nevertheless, the carriage will not travel over the sprockets and cause damage to the sprockets or other portions of the drive mechanism.

It is also possible to easily and quickly obtain manual operation in the event of a power failure or the like. In this case, one merely needs to pull the pin from its engaged position in the enlarged link and this will allow the chain to travel freely about the sprockets. Moreover, in the event that the motor is energized and the pin is removed from its engaged position in the enlarged link, the chain will continuously travel about the sprockets but will not carry therewith the carriage and the gate or door affixed to the carriage.

Thus, there has been illustrated and described a unique and novel overhead door operator which is capable of moving a door between an opened and closed position without creating any damage to the drive mechanism in the event that a carriage forming part of the operator is moved in proximity to a drive roller or sprocket. The present invention thereby fulfills all of the objects and advantages which have been sought. It should be understood that many changes, modifications, variations and other uses and applications which will become apparent to those skilled in the art after considering this specification and the accompanying drawings forming a part of the present invention. Therefore, any and all such changes, modifications, variations and other uses and applications which do not depart from the spirit and scope of the invention are deemed to be covered by the invention.

Having thus described our invention, what we desire to claim and secure by letters patent is:

1. An overhead door operator capable of moving a door between an opened position and a closed position, said door operator comprising:

a) a powered drive means;

b) a guide means forming a guide path for controlling a movement of a door during driving movement in said guide path between the opened and closed positions;

c) a chain comprised of a plurality of links powered for movement by said drive means with respect to said guide means, at least one of said links being an enlarged link and having an enlarged opening and which is larger than openings in the other of said links;

d) a rotatable element located with respect to said guide means allowing the chain to be trained and rotated thereabout during a portion of movement with respect to the guide path;

e) a carriage movable by said chain with respect to said guide means during driving movement of said chain and capable of moving a door therewith during movement between the opened and closed positions; and f) release means comprising a releasable pin being engagable only with an enlarged link in said chain for enabling said carriage to be movable with said chain when said chain is driven, said pin being disengagable from said enlarged link for disengaging the carriage from the chain to enable manual movement of the carriage independently of the chain.

2. The overhead door operator of claim 1 further characterized in that the door is a garage door and the guide means is a trackway for locating the garage door with respect to the guide means.

3. The overhead door operator of claim 2 further characterized in that said chain is movable in said trackway.

4. The overhead door operator of claim 3 further characterized in that a pair of spaced apart trackways are provided to receive the door and a pair of chains are provided with each one being located in a separate one of the trackways and the trackways define the guide path.

5. The overhead door operator of claim 1 further characterized in that said pin is a manually actuable release pin and only is engagable with an enlarged link and not with links which are not enlarged links, said pin being removable from engagement with an enlarged link to enable manual disengagement of the carriage from the chain.

6. The overhead door operator of claim 5 further characterized in that said link with the enlarged opening is a double pitch link.

7. The overhead door operator of claim 1 further characterized in that said release means comprises a coupling member secured to said carriage and having said releasable pin extended to and engagable with an enlarged link in said chain in such manner that the enlarged link of the chain will not move over the rotatable element when the pin is engaged with the enlarged link thereby stopping movement of the carriage.

8. The overhead door operator of claim 7 further characterized in that said pin is spring biased into engagement with said chain.

9. The overhead door operator of claim 7 further characterized in that spring means biases said pin into engagement with said chain, said pin is manually engagable and is capable of being pulled from engagement with the chain against the action of the spring means.

10. A drive mechanism for moving a door having a partially vertically arranged movement path within a guide way to an angularly displaced direction, said drive mechanism comprising:

a) a carriage which is movable in the portion of the movement path which is vertically arranged;

b) a mounting block on said carriage;

c) a drive chain movable along said guide way and having a plurality of links and with at least one of said links being an enlarged link and having an opening which is larger than openings in other of said links;

d) a rotatable element allowing said drive chain to move in the portion of the movement path which is vertically arranged and also in the angularly displaced direction and which drive chain is trained about said rotatable element;

e) a releasable pin on said mounting block engagable with said enlarged link but not with links which are not an enlarged link; and f) means biasing said pin into engagement with the enlarged link thereby allow the mounting block and carriage to move in the portion of the movement path which is vertically arranged but which precludes movement about the rotatable element, said pin also being manually removable from said enlarged link allowing the carriage and door secured thereto to be moved independently of the chain.

11. The drive mechanism for moving the carriage and door secured thereto of claim 10 further characterized in that said rotatable element is a sprocket sized to receive the links on said chain.

12. The drive mechanism for moving the carriage and door secured thereto of claim 10 further characterized in that said pin is provided with a head for manual engagement such that the pin can be pulled from engagement with the chain.

13. The drive mechanism for moving the carriage and door secured thereto of claim 12 further characterized in that said mounting block in a slidable member within said guide may and said pin is shiftable in said mounting block, said mounting block also having an opening to receive said chain.

14. The drive mechanism for moving the carriage and door secured thereto of claim 13 further characterized in that said means biasing said pin is a spring means.

15. The drive mechanism for moving the carriage and door secured thereto of claim 14 further characterized in that said link with the enlarged opening is a double pitch link.

16. An overhead door arrangement in which a door is moved between an opened position and a closed position in a generally vertically arranged movement path and partially in a movement path agulated with respect to the generally vertically arranged movement path, said overhead door arrangement comprising:

a) a powered drive means;

b) a guide means for controlling a path of movement of a door during driving movement between the opened and closed positions;

c) a chain comprised of a plurality of links powered for movement by said drive means with respect to said guide means and at least one of said links being a differently sized link than others of said links;

d) a retractable element located with respect to said guide means allowing the chain to be rotated thereabout during a portion of the movement with respect to the guide means;

e) a carriage movable by said chain with respect to said guide means during driving movement of said chain and capable of moving a door with said carriage during movement between the opened and closed positions;

f) a door movable in the guide means and being secured to the carriage for movement therewith; and g) release means comprising a pin engagable only with said at least one differently sized link for disengaging the carriage from the chain when said pin is removed from said at least one differently sized link to enable manual movement of the carriage independently of the chain.

17. The overhead door arrangement of claim 16 further characterized in that the guide means comprises a pair of spaced apart trackways each of which receives a separate driven chain.

18. An overhead door operator capable of moving a door between an opened position and a closed position, said door operator comprising:

a) a powered drive means;

b) a guide means comprising a pair of spaced apart trackways to define a guide path and receive said door, said guide path formed by the trackways controlling movement of the door during driving movement in said guide path between the opened and closed positions;

c) a chain in at least one of said trackways with such chain comprised of a plurality of links, at least one of said chains being a drive chain powered for movement by said drive means with respect to said guide means;

d) a rotatable element located with respect to said guide means allowing the drive chain to be trained and rotated thereabout during a portion of movement with respect to the guide path;

e) a carriage movable by at least one of said chains with respect to said guide means during driving movement of said drive chain and capable of moving a door therewith during movement between the opened and closed positions; and f) release means for disengaging the carriage from the drive chain to enable manual movement of the carriage independently of the drive chain.

19. The overhead door operator of claim 18 further characterized in that both of said chains are drive chains and each are powered for movement by said drive means with respect to said guide means.

20. The overhead door operator of claim 18 further characterized in that a manually actuable release member is also associated with said release means to enable manual disengagement of the carriage from the chain.

21. The overhead door operator of claim 18 further characterized in that said release means comprises a coupling member secured to said carriage and having a releasable pin extended to and engagable with an enlarged link in said chain in such manner that the enlarged link of the chain will not move over the rotatable element when the pin is engaged therewith thereby stopping movement of the carriage.

22. The overhead door operator of claim 21 further characterized in that spring means biases said pin into engagement with said chain, said pin is manually engagable and is capable of being pulled from engagement with the chain against the action of the spring means.

23. A drive mechanism for moving a carriage having a partially vertically arranged movement path within a guide way to an angularly displaced direction, said drive mechanism comprising:

a) a carriage which is movable in the portion of the movement path which is vertically arranged;

b) a mounting block on said carriage;

c) a pair of spaced apart tracks defining said guide way;

d) at least one driven drive chain movable at one of said tracks and said drive chain having a plurality of links and also having at least one enlarged link also being capable of movement over the rotatable element;

e) a rotatable element allowing said drive chain to move in the portion of the movement path which is vertically arranged and also in the angularly displaced direction and which drive chain is trained about said rotatable element;

f) a releasable pin on said mounting block engagable with said enlarged line; and g) means biasing said pin into engagement with the enlarged link thereby allowing the mounting block and carriage to move in the portion of the movement path which is vertically arranged but which precludes movement about the rotatable element.

24. The drive mechanism for moving the door mountable carriage of claim 23 further characterized in that said mounting block is a slidable member within said guide way and said pin is shiftable in said mounting block, said mounting block also having an opening to receive said chain.

* * * * *